United States Patent [19]

Gilbert et al.

[11] Patent Number: 4,852,921

[45] Date of Patent: Aug. 1, 1989

[54] DOOR SECURITY DEVICE

[76] Inventors: Eugene Gilbert; Cynthia J. Gilbert, both of HC 74 Box 238, Mountain View, Ark. 72560

[21] Appl. No.: 189,791

[22] Filed: May 3, 1988

[51] Int. Cl.[4] ..... E05C 19/18

[52] U.S. Cl. ..... 292/259 R; 292/288

[58] Field of Search ..... 292/258, 259, 262, 288, 292/294

[56] References Cited

U.S. PATENT DOCUMENTS

| | | | |
|---|---|---|---|
| 3,980,328 | 9/1976 | Pearson | 292/259 X |
| 4,067,598 | 1/1978 | Mansour | 292/259 R |
| 4,078,836 | 3/1978 | Wilson | 292/259 R |
| 4,079,972 | 3/1978 | Hagopian | 292/259 R |
| 4,082,332 | 4/1978 | Palmer | 292/259 R |
| 4,429,911 | 2/1984 | O'Neal et al. | 292/259 R |
| 4,462,625 | 7/1984 | Barnhill | 292/259 R |
| 4,570,985 | 2/1986 | Waldo et al. | 292/262 |
| 4,667,992 | 5/1987 | Roden, Jr. | 292/259 R |

*Primary Examiner*—Richard E. Moore

*Attorney, Agent, or Firm*—Leon Gilden

[57] ABSTRACT

A door security device is formed as a plurality of bars wherein a first bar is telescopingly received within a second bar. The extended length of the telescoping bars are of a span greater than that of an associated door frame. A bifurcated door knob latching bracket is orthogonally adjustable relative to the aligned axis of the aforenoted bars for positioning of the bracket in an overlying relationship to a door knob secured to a door fitted within the aforenoted framework. A pair of spaced resilient pad means are secured to each terminal end of the telescoping bars in contact with the door frame to accordingly prevent unauthorized opening of the door when the instant invention is secured relative thereto.

6 Claims, 3 Drawing Sheets

DOOR SECURITY DEVICE

BACKGROUND OF THE INVENTION

1. Field of the Invention

The instant invention relates to security devices, and more particularly pertains to a new and improved security device for use particularly in cooperation with outwardly opening doors, as is typically found in mobile homes and the like.

2. Description of the Prior Art

The use of various security bars to secure an associated door against unauthorized opening have been developed in the prior art. Typically these security devices are used in combination with inwardly opening doors relative to a dwelling strucutre, but the need for a security bar to maintain an outwardly opening door relative to a structure, as is typically found in mobile home construction, of efficient and effective organization is yet to be developed in the prior art. For example, U.S. Pat. No. 4,079,972 to Hagopian includes a telescoping rod formed with a loop at one end for insertion around a door knob and a spacer at the other end for contact of a wall adjacent to an associated door. The telescoping rod is threaded through a ring chain which is slipped through one of the doors hinges wherein the spacer is of a variable thickness so as to jam the rod into position for positive contact relation to the door and prevent unauthorized opening of the associated door.

U.S. Pat. No. 4,082,332 to Palmer sets forth a security bar for use in combination with inwardly opening doors wherein a bar is securable exteriorly of an associated door frame within brackets wherein said bar further includes a resilient doughnut secured about said bar proximate a free side edge of the door to minimize damage to the door. The prior art, as is typified in the Palmer patent, is generally designed and arranged for prevention of unwanted opening of inwardly opening doors, as opposed to the instant invention.

U.S. Pat. No. 4,429,911 to O'Neal sets forth a further example of a security bar wherein a plurality of spaced brackets secured exteriorly of an associated door frame are mounted to a wall surface wherein a first mounting bracket includes an elongate hole to receive one bar flange wherein the opposite bracket includes a "T" shaped slot for admitting the opposite door flange bar therein at the intersection of the horizontal and vertical slots of the "T". The O'Neal patent is again typical of security devices arranged to prevent opening of inwardly pivoted doors relative to an existing dwelling and accordingly require bracketry to maintain the bar in operative relationship to the door. The instant invention in contrast merely utilizes friction pads for maintaining a non-slip relationship with an associated door frame while securing the door with attachment of a bifurcated downwardly depending bracket to a rearward surface of an associated door knob.

U.S. Pat. No. 4,462,625 to Barnhill sets forth a door safety latch wherein a first bracket secured to an extension of one of the plurality of door hinges securing a door with a second bracket securable to an opposing vertical door frame for securement of the safety bar thereto consistent with prior art of this character.

As such, it may be appreciated that there is a continuing need for a new and improved door security device which addresses both the problem of security and ease of use in exteriorly opening doors, and in this respect, the present invention substantially fulfills this need.

SUMMARY OF THE INVENTION

In view of the foregoing disadvantages inherent in the known types of door security devices now present in the prior art, the present invention provides an door security device wherein a plurality of telescoping bars and an associated downwardly depending bracket readily and effectively maintain a door against unwarranted opening when positioned in engagement of opposed door frames and a door knob of the door. As such, the general purpose of the present invention, which will be described subsequently in greater detail, is to provide a new and improved door security device which has all the advantages of the prior art door security devices and none of the disadvantages.

To attain this, the present invention comprises a plurality of telescoping bars wherein the first bar is telescopingly and slidingly housed within a second bar formed with a complementary interior relative to the first bar's exterior. An orthogonally adjustable downwardly depending bifurcated bracket is securable to the second of the telescoping bars for securement about an associated door know with a plurality of friction pads fixedly secured to opposed ends of the first and second bars of frictional engagement with opposed vertically positioned door frames relative to the associated door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door security device which has all the advantages of the prior art door security devices and none of the disadvantages.

It is another object of the present invention to provide a new and improved door security device which may be easily and efficiently manufactured and marketed.

It is a further object of the present invention to provide a new and improved door security device which is of a durable and reliable construction.

An even further object of the present invention is to provide a new and improved door security device which is susceptible of a low cost of manufacture with regard to both materials and labor, and which accordingly is then susceptible of low prices of sale to the consuming public, thereby making such door security devices economically available to the buying public.

Still yet another object of the present invention is to provide a new and improved door security device which provides in the apparatuses and methods of the prior art some of the advantages thereof, while simultaneously overcoming some of the disadvantages normally associated therewith.

Still another object of the present invention is to provide a new and improved door security device wherein a plurality of telescoping interrelated bars are formed with friction surfaces for engagement of opposed surfaces of an associated pair of vertically disposed door frames with a bifurcated bracket for securement of an associated door knob to prevent unwarranted opening of outwardly pivoted doors, as found typically in mobile homes and the like.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
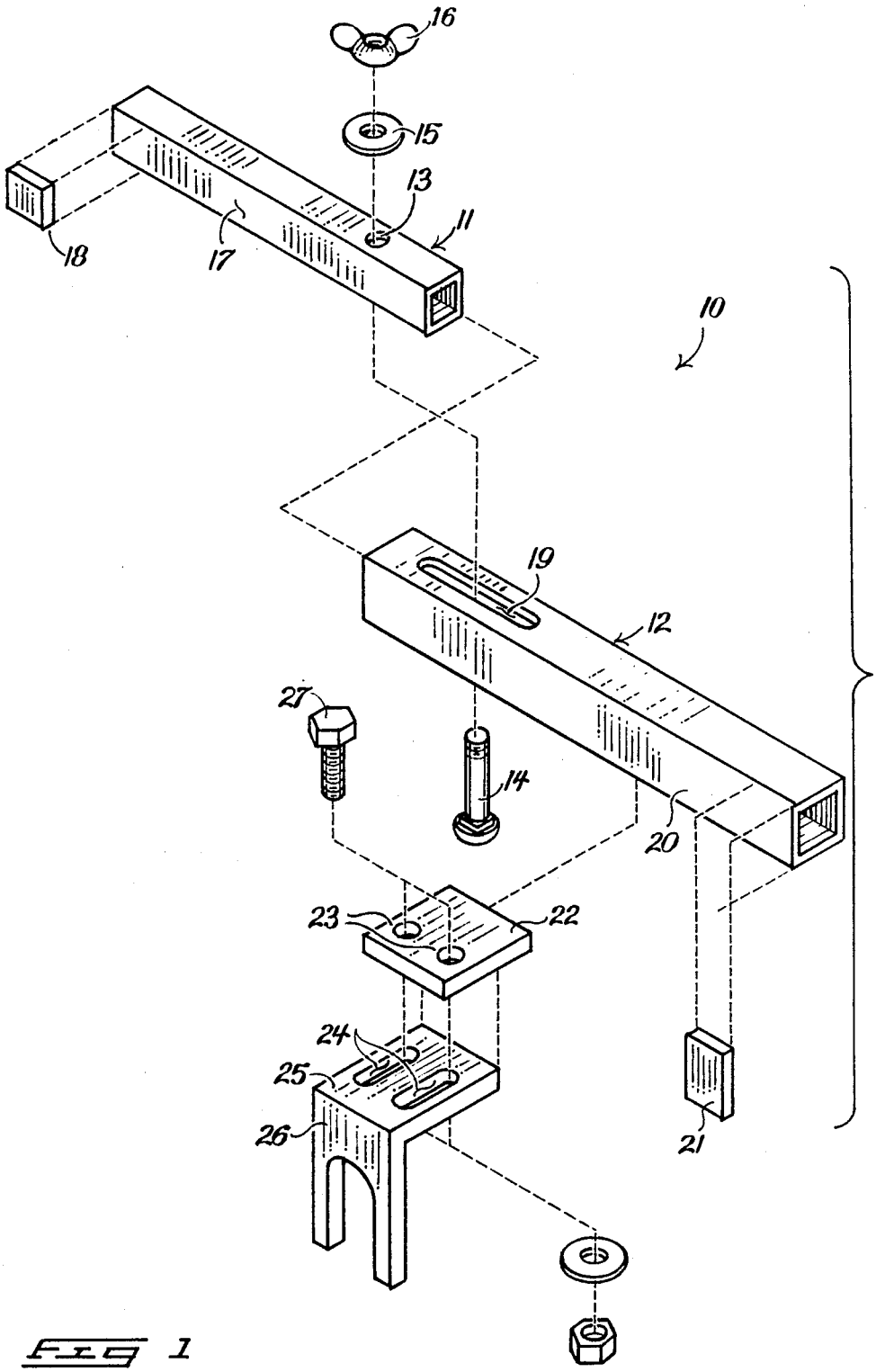
FIG. 1 is an isometric exploded view of the instant invention.
Figure 2:
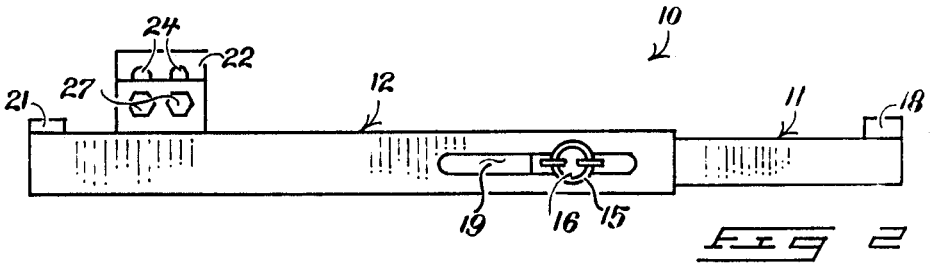
FIG. 2 is a top orthographic view of the instant invention.

With reference now to the drawings, and in particular to FIG. 1 thereof, a new and improved door security device embodying the principles and concepts of the present invention and generally designated by the reference numeral 10 will be described.

More specifically, it will be noted that the door security device 10 essentially comprises a first bar 11 of a first square parallel pipet configuration slidably securable in a telescoping relationship to a second bar 12 of a second square parallel pipet configuration with an internal configuration of complementary shape to said first square parallel pipet configuration defining said first bar 11.

The first bar 11 contains opposed through extending aligned apertures 13 formed through upper and lower respective surfaces of the first bar 11. The second bar 12 has formed through upper and lower surfaces aligned with second bar slots 19 parallel to and aligned with an axis defining said second bar 12 in a like manner as the opposed aligned apertures 13 are aligned with a longitudinal axis defining the first bar 11.

Figure 6:
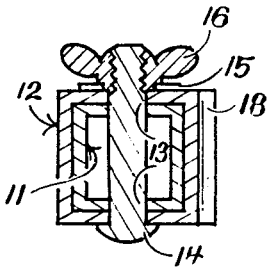
FIG. 6 is an orthographic side view taken along the lines 6—6 of FIG. 3 in the direction indicated by the arrows.
Figure 7:
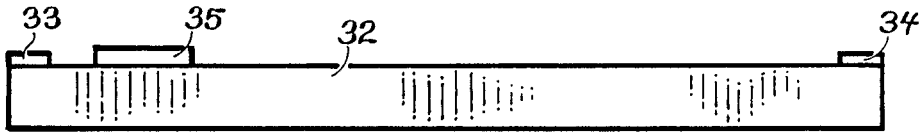
FIG. 7 is an orthographic top view of simplified embodiment of the instant invention.
Figure 8:
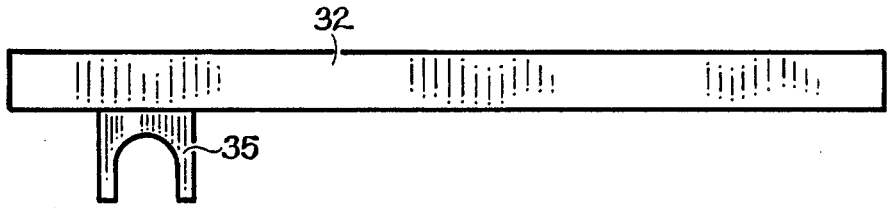
FIG. 8 is an orthographic rear view of the simplified embodiment as set forth in FIG. 7.
Figure 9:
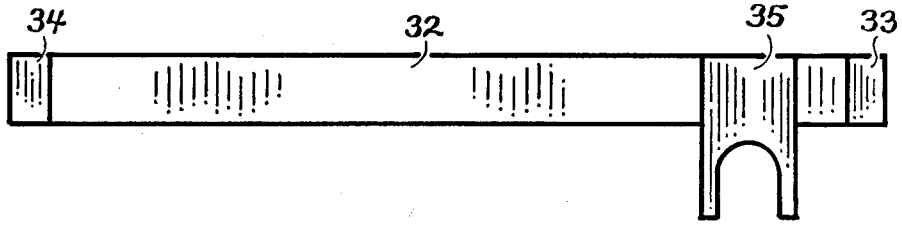
FIG. 9 is an orthographic front view taken in elevation of the simplified embodiment of the instant invention.
Figure 10:
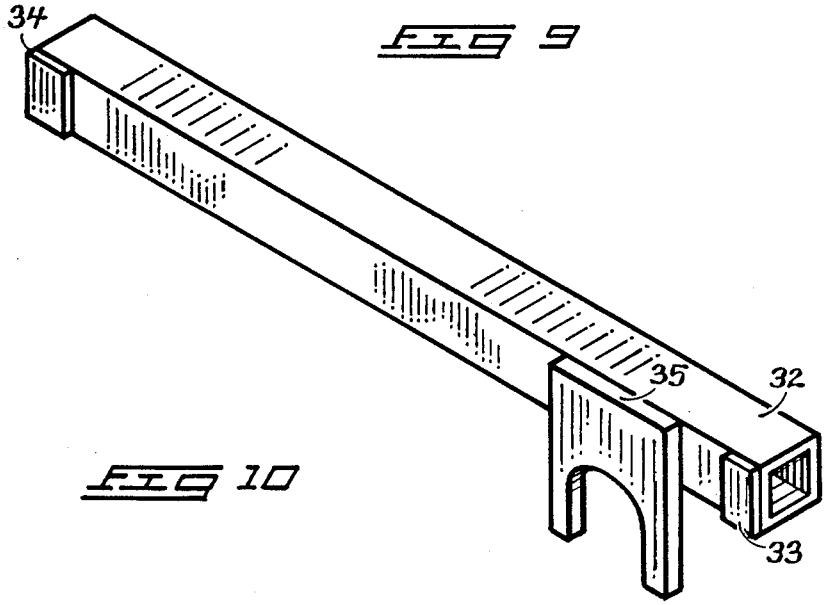
FIG. 10 is an isometric illustration of the simplified embodiment of the instant invention.

In this manner when first bar 11 is received within second bar 12, the aligned apertures 13 are aligned slots 19 are super-imposed over one another, as illustrated in FIG. 6, to enable a through extending bolt 14 with a pressure secure washer 15 positioned against an upper surface of the second bar 12 and secured with a wing nut 16, as illustrated in FIGS. 1 to 4 and 6.

A terminal end of the first bar 11 has formed thereon on a forward face 17 a first resilient engagement pad 18 formed of a resilient rubber-like material whereas in a similar manner, a forward face 20 of second bar 12 has formed in a terminal end thereof a second resilient engagement pad 21.

Figure 5:
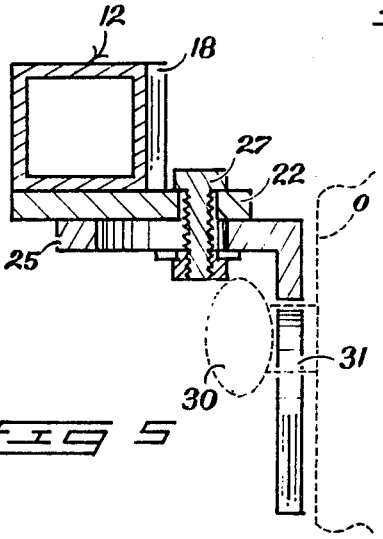
FIG. 5 is an orthographic side view taken along the lines 5—5 of FIG. 3 in the direction indicated by the arrows.

A base bracket 22 is integrally secured to a lower surface of the second bar 12, as illustrated in FIG. 5 for example, and formed proximate a forward edge thereof with a pair of first bores 23 spaced on equal distance from a forward edge of the base bracket 22. An "L" shaped door knob bracket is securable to an underlying surface of the base bracket 22 and is formed with a plurality of bracket slots 24 orthogonally oriented to the axis of the second bar 12. Accordingly, the "L" shaped door knob bracket is securable to the base bracket 22 by a plurality of fasteners 27, as illustrated in FIGS. 1 through 5. A downwardly extending bifurcated forward plate 26 is integrally secured to a top plate 25 having the bracket slots 24 formed therethrough wherein the bifurcated plate 26 is formed with a plurality of downwardly extending legs defining a downwardly extending "U" shaped opening for securement about an associated door knob 30 to secure the door knob 30 between an associated door "D" and a door knob axle 31, as illustrated in phantom in FIG. 5.

Figure 3:
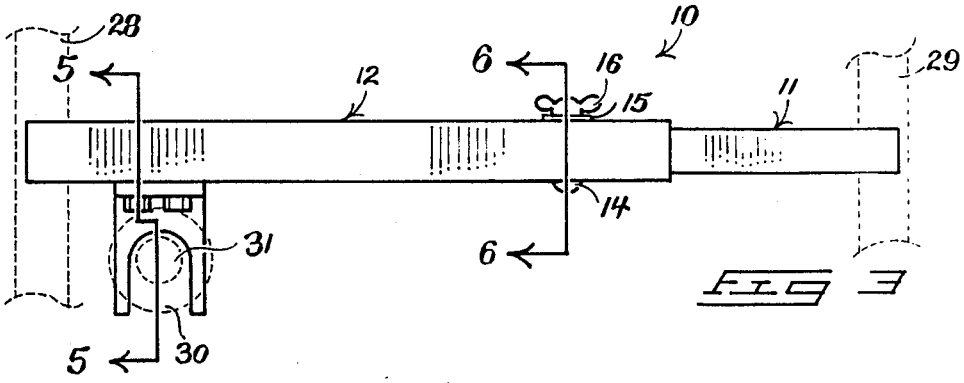
FIG. 3 is a rear orthographic view taken in elevation of the instant invention.
Figure 4:
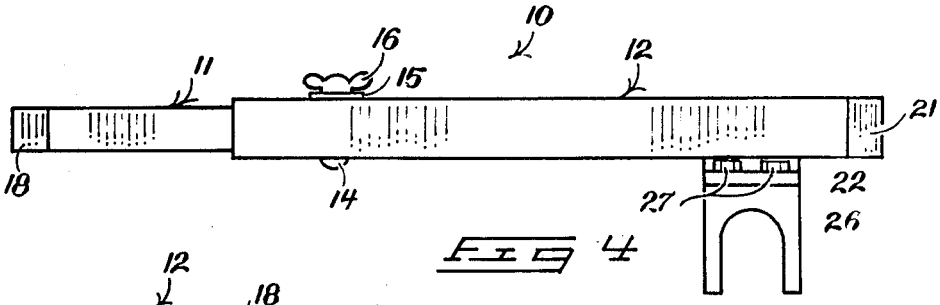
FIG. 4 is a front orthographic view taken in elevation of the instant invention.

As illustrated in FIG. 3, the apparatus 10 is telescoped wherein the apparatus 10 is of a length to substantially equal that of a span defining a distance between a first vertical door frame member 28 and a second vertical door frame member 29, as illustrated in phantom in FIG. 3, wherein the "L" shaped bracket is adjusted to enable securement about the associated door knob 30 and door knob axle 31.

Attention to FIGS. 7 to 10 illustrates a simplified embodiment of the instant invention wherein a single bar defined as a rectangular parallel pipet has formed a first resilient pad 33 at a first terminal end thereof and a second resilient pad 34 at a distal terminal end thereof to span a fixed distance between door frames with a downwardly depending securement bracket 35 for use essentially as described above. The modification, as illustrated in FIGS. 7 through 10, however, does not avail itself to adjustment to variations in manufacturing and door widths and the like.

The parallel pipet configuration is selected specifically for the enhanced sheer strength of the parallel pipet configuration and is preferred to that of a curvilinear or arcuate bar construction.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door securement device for use in combination with a door pivotally mounted to a structure between a first and second vertical door frame defining a door opening therebetween wherein said door is mounted for pivotal motion to said second door frame to position exteriorly of the structure, and said device is mountable interiorly of said structure, said device comprising, a first elongate bar means of a first constant cross-sectional external configuration;

a second elongate bar means of a second constant cross-sectional external configuration with an internal cross-sectional configuration equal to said first external cross-sectional configuration for slidingly and telescopingly receiving said first elongate bar means within said second elongate bar means, a terminal end of a first bar forward face of said first bar means including a first engagement pad means for frictional engagement with said first door frame, said second bar means including a second bar forward face parallel to said first bar forward face including a terminal end surface including a second engagement pad means for frictional engagement with said second door frame;

adjustment lock means for releasably locking said first bar means within said second bar means at a predetermined distance greater than said door opening, and door handle bracket means adjustably mounted to said second bar means for engagement with an interior surface of a door knob wherein said interior surface is oriented between said door knob and said door about a door knob axle rotatably securing said door knob through said door orthogonally thereto.

2. A door securement device as set forth in claim 1 wherein said door handle bracket means includes a base bracket orthogonally and integrally secured to a bottom surface of said second bar means projecting beyong the forward face of said second bar means wherein said base bracket includes a plurality of through extending apertures, and an "L" shaped door knob bracket securable to a bottom surface of said base bracket wherein said "L" shaped door knob bracket includes a top plate with a plurality of bracket slots orthogonally oriented to said forward face of the second bar means and spaced apart a distance equal to the spacing of said bores of said base bracket including a plurality of fasteners with a fastener positionable through said bores and said slots for adjustably positioning said "L" shaped door knob bracket orthogonally relative to said second bar means, and said "L" shaped door knob bracket includes a forward plate orthogonally and integrally secured to said top plate wherein said forward plate includes a plurality of downwardly extending legs defining a "U" shaped opening means greater than the diameter defining said door knob axle and less than a diameter defining said door knob.

3. A door security device as set forth in claim 2 wherein said first and second engagement pad means are formed of resilient rubber-like material for frictional engagement with said respective first and second door frames.

4. A door security device as set forth in claim 3 wherein said first bar means includes a plurality of aligned apertures through respective top and bottom surfaces of said first bar means and positioned bisecting a first axis defining said first bar means, and a plurality of aligned second bar slots formed through upper and lower surfaces of said second bar means aligned with a second axis defining said second bar means wherein said second bar slots are positionable and aligned with said aligned apertures of said first bar means when said first bar means is positioned within said second bar means.

5. A door security device as set forth in claim 4 wherein a threaded fastener is positionable through said second bar slots and said aligned apertures of said first bar means for selective securement of said first bar means within said second bar means.

6. A door securement device as set forth in claim 5 wherein said threaded fastener is secured by a wing nut for manual tightening an untightening of said threaded fastener to enable positioning of said first bar means relative to said second bar means.

* * * * *